US011717101B1

(12) United States Patent
Gui et al.

(10) Patent No.: US 11,717,101 B1
(45) Date of Patent: Aug. 8, 2023

(54) DOUBLE-DRINKING-MOUTH PORTABLE CUP

(71) Applicant: Yingjie Gui, Yongzhou (CN)

(72) Inventors: Dan Gui, Yongzhou (CN); Desheng Deng, Yongzhou (CN)

(73) Assignee: Yingjle Gui, Yongzhou (CN)

( * ) Notice: Subject to any disclaimer, the term of this patent is extended or adjusted under 35 U.S.C. 154(b) by 0 days.

(21) Appl. No.: 17/720,162

(22) Filed: Apr. 13, 2022

(51) Int. Cl.
*A47G 19/22* (2006.01)
*B65D 43/16* (2006.01)

(52) U.S. Cl.
CPC ..... *A47G 19/2272* (2013.01); *B65D 43/165* (2013.01)

(58) Field of Classification Search
CPC ..... A47G 19/2272; A47G 19/2266; A47G 19/2205; B65D 1/40; B65D 43/165; B65D 43/164; B65D 43/163; B65D 43/16
USPC ..... 220/713, 711, 708, 705, 254.3, 254.1, 220/259.1, 256.1, 62.18, 62.12, 62.11, 220/844, 843, 836, 810
See application file for complete search history.

(56) References Cited

U.S. PATENT DOCUMENTS 5,203,468 A * 4/1993 Hsu ..... B65D 47/2037 222/530
5,339,982 A * 8/1994 Tardie ..... A47G 19/2266 215/229
5,346,081 A * 9/1994 Lin ..... B65D 47/2037 220/259.2
2010/0108693 A1* 5/2010 Zhang ..... B65D 1/265 220/592.2

FOREIGN PATENT DOCUMENTS

CA 2873066 A1 * 5/2013 ..... A47G 19/2266
CN 214156944 U 9/2021
CN 214855852 U 11/2021
CN 215190763 U 12/2021

* cited by examiner

*Primary Examiner* — Robert J Hicks

(57) ABSTRACT

The present invention details a double-drinking-mouth portable cup, comprising a cup body. A cup cover is in threaded connection to the top of the cup body; a groove is formed in the top of the cup cover; and a cup mouth drinking structure is disposed in the groove. For the present invention, by disposing the cup mouth drinking structure and a sucking drinking structure on the top of the cup cover, the cup cover can have double drinking modes, so that the application range of the cup body may be enlarged, the use convenience of the cup body is greatly improved, and the problem that an existing water cup cannot meet the drinking demands in different environments due to relatively single structure and function and only one drinking mouth, so that the application range of the water cup is severely affected is solved.

7 Claims, 6 Drawing Sheets

DOUBLE-DRINKING-MOUTH PORTABLE CUP

TECHNICAL FIELD

The present disclosure relates to the technical field of vessels, in particular to a double-drinking-mouth portable cup.

BACKGROUND

A water cup is a vessel for carrying liquid. However, an existing water cup cannot meet the drinking demands in different environments due to relatively single structure and function and only one drinking mouth, so that the application range of the water cup is severely affected.

SUMMARY

In order to solve the above problem in the Background, an objective of the present disclosure is to provide a double-drinking-mouth portable cup, which has the advantage of various drinking methods and solves the problem that the existing water cup cannot meet the drinking demands in different environments due to relatively single structure and function and only one drinking mouth, so that the application range of the water cup is severely affected.

In order to achieve the above objective, the present disclosure provides the following technical solution: disclosed is a double-drinking-mouth portable cup, comprising a cup body.

A cup cover is in threaded connection to the top of the cup body; a groove is formed in the top of the cup cover; a cup mouth drinking structure is disposed in the groove; a receiving groove mutually communicating with the groove is formed in the top of the cup cover; and a sucking drinking structure is disposed in the receiving groove.

Preferably in the present disclosure, the cup mouth drinking structure comprises a drinking hole formed in the top of the cup cover; the drinking hole mutually communicates with the groove; a flip cover is movably connected to the interior of the groove through a pin shaft; a snap is disposed on the left side of the flip cover; and one side, far away from the flip cover, of the snap extends to the left side of the cup body and is mutually in clamping connection with the surface of the cup body.

Preferably in the present disclosure, the sucking drinking structure comprises a connecting pipe communicating with the top of the cup cover; the connecting pipe is disposed in the receiving groove; a suction nozzle is movably connected to the interior of the receiving groove through a pin shaft; a sucking hole is formed in the suction nozzle and can mutually communicate with the connecting pipe; and a pipe sleeve disposed in the cup body is in threaded connection to the surface of the connecting pipe.

Preferably in the present disclosure, air inlets are formed in the left side and the right side of the top of the cup cover respectively and are formed in the bottoms of the flip cover and the suction nozzle respectively.

Preferably in the present disclosure, a rubber block is fixedly connected to the bottom of the flip cover; and one side, far away from the flip cover, of the rubber block is inserted into the drinking hole.

Preferably in the present disclosure, a sealing ring is disposed on the surface of the connecting pipe in a sleeved manner; and the top of the sealing ring makes contact with the surface of the suction nozzle Preferably in the present disclosure, a dustproof cover is movably connected to the interior of the receiving groove through the pin shaft and is disposed on the surface of the suction nozzle in the sleeved manner.

Preferably in the present disclosure, the cup body is formed by an inner layer and an outer layer; the outer layer is disposed on the surface of the inner layer in the sleeved manner; and the tops of the inner layer (and the outer layer are mutually welded.

Compared with the prior art, the present disclosure has the beneficial effects that:

1. By disposing the cup mouth drinking structure and a sucking drinking structure on the top of the cup cover, the cup cover can have double drinking modes, so that the application range of the cup body may be enlarged, the use convenience of the cup body is greatly improved, and the problem that the existing water cup cannot meet the drinking demands in different environments due to relatively single structure and function and only one drinking mouth, so that the application range of the water cup is severely affected is solved.

2. By disposing the drinking hole and the flip cover, smooth water outlet during water drinking can be ensured; and the flip cover may protect the contact position of a mouth to be clean and sanitary.

3. By disposing the connecting pipe, the suction nozzle, the sucking hole and the pipe sleeve, the cup body can have the effect of drinking with sucking, and thus the drinking mode of the water cup is further improved.

4. By disposing the air inlets, pressure in the cup body can be balanced, and then drinking with sucking is prevented from being affected by the pressure.

5. By disposing the rubber block, the sealing effect of the flip cover can be improved, and then the liquid is prevented from leaking from a gap between the drinking hole and the flip cover.

6. By disposing the sealing ring, the connection stability between the connecting pipe and the cup cover can be improved, and the sealing communicating effect of the suction nozzle may be improved at the same time.

7. By disposing the dustproof cover, the suction nozzle can be protected, and then a contact area between the suction nozzle and the external environment is reduced.

8. By disposing the inner layer and the outer layer, the cup body can have the thermal insulation effect, and then heat exchange between the liquid in the cup body and the external environment is prevented.

DETAILED DESCRIPTION OF THE EMBODIMENTS

Shown in FIGS. 1-6, the present disclosure provides a double-drinking-mouth portable cup, comprising a cup body 1.

A cup cover 2 is in threaded connection to the top of the cup body 1; a groove 3 is formed in the top of the cup cover 2; a cup mouth drinking structure is disposed in the groove 3; a receiving groove 4 mutually communicating with the groove 3 is formed in the top of the cup cover 2; and a sucking drinking structure is disposed in the receiving groove 4.

Figure 6:
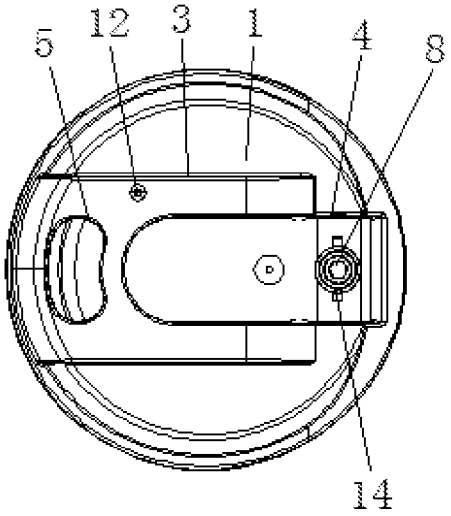
FIG. 6 is a top sectional diagram of a local structure of the present disclosure.

Referring to FIG. 6, the cup mouth drinking structure comprises a drinking hole 5 formed in the top of the cup cover 2; the drinking hole 5 mutually communicates with the groove 3; a flip cover 6 is movably connected to the interior of the groove 3 through a pin shaft; a snap 7 is disposed on the left side of the flip cover 6; and one side, far away from the flip cover 6, of the snap 7 extends to the left side of the cup body 1 and is mutually in clamping connection with the surface of the cup body 1.

As a technical optimized solution of the present disclosure, by disposing the drinking hole 5 and the flip cover 6, smooth water outlet during water drinking can be ensured; and the flip cover 6 may protect the contact position of a mouth to be clean and sanitary.

Figure 3:
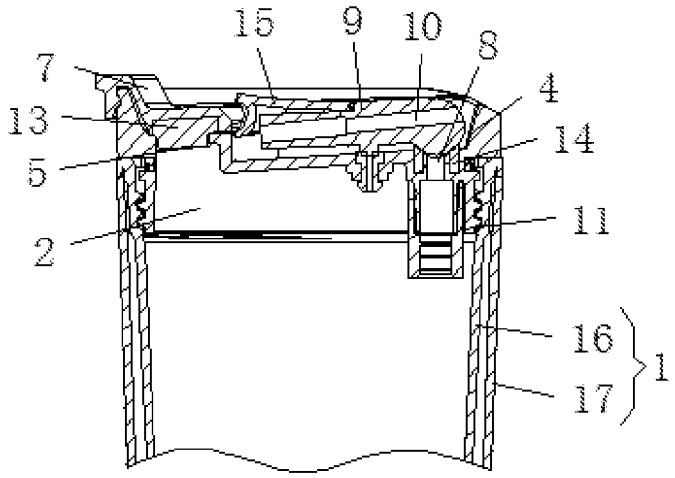
FIG. 3 is a front sectional diagram of a local structure of the present disclosure.
Figure 4:
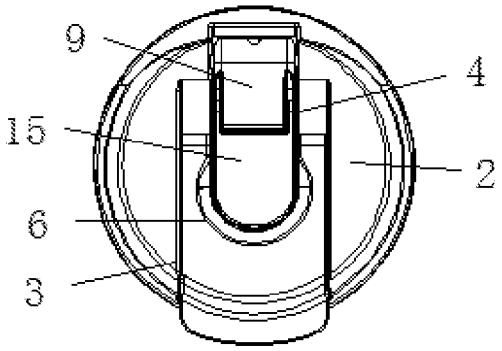
FIG. 4 is a top structural schematic diagram of the present disclosure.
Figure 5:
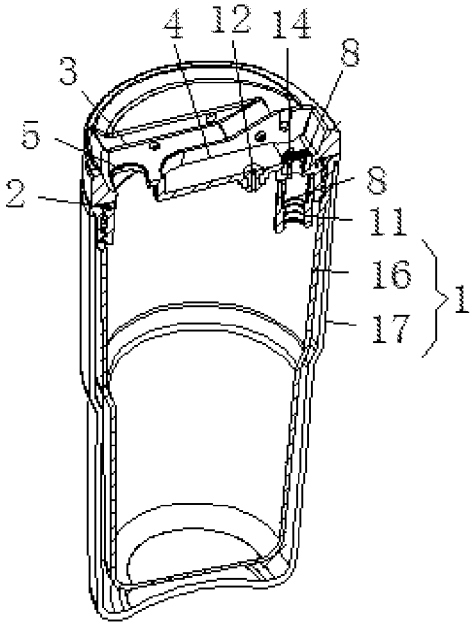
FIG. 5 is a sectional diagram of a stereoscopic structure of the present disclosure.

Referring to FIG. 3, the sucking drinking structure comprises a connecting pipe 8 communicating with the top of the cup cover 2; the connecting pipe 8 is disposed in the receiving groove 4; a suction nozzle 9 is movably connected to the interior of the receiving groove 4 through a pin shaft; a sucking hole 10 is formed in the suction nozzle 9 and can mutually communicate with the connecting pipe 8; and a pipe sleeve 11 disposed in the cup body 1 is in threaded connection to the surface of the connecting pipe 8.

As a technical optimized solution of the present disclosure, by disposing the connecting pipe 8, the suction nozzle 9, the sucking hole 10 and the pipe sleeve 11, the cup body 1 can have the effect of drinking with sucking, and thus the drinking mode of the water cup is further improved.

Referring to FIG. 6, air inlets 12 are formed in the left side and the right side of the top of the cup cover 2 respectively and are formed in the bottoms of the flip cover 6 and the suction nozzle 9 respectively.

As a technical optimized solution of the present disclosure, by disposing the air inlets 12, pressure in the cup body 1 can be balanced, and then drinking with sucking is prevented from being affected by the pressure.

Referring to FIG. 3, a rubber block 13 is fixedly connected to the bottom of the flip cover 6; and one side, far away from the flip cover 6, of the rubber block 13 is inserted into the drinking hole 5.

As a technical optimized solution of the present disclosure, by disposing the rubber block 13, the sealing effect of the flip cover 6 can be improved, and then liquid is prevented from leaking from a gap between the drinking hole 5 and the flip cover 6.

Referring to FIG. 3, a sealing ring 14 is disposed on the surface of the connecting pipe 8 in a sleeved manner; and the top of the sealing ring 14 makes contact with the surface of the suction nozzle 9.

As a technical optimized solution of the present disclosure, by disposing the sealing ring 14, the connection stability between the connecting pipe 8 and the cup cover 2 can be improved, and the sealing communicating effect of the suction nozzle 9 may be improved at the same time.

Figure 1:
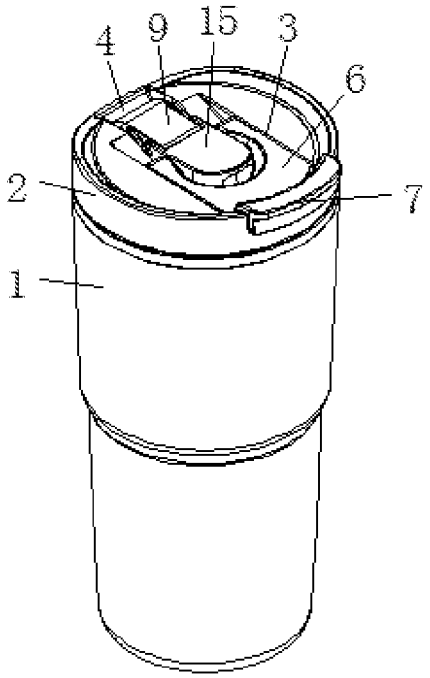
FIG. 1 is a structural schematic diagram of the present disclosure.
Figure 2:
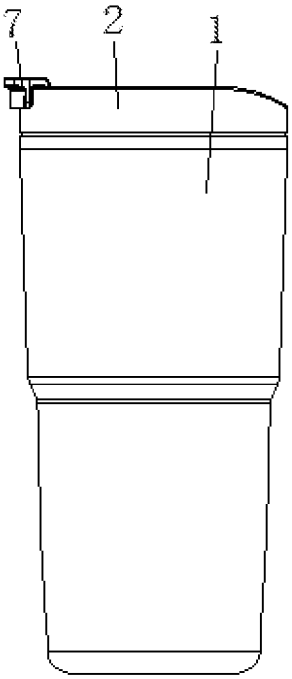
FIG. 2 is a front structural schematic diagram of the present disclosure.

Referring to FIG. 1, a dustproof cover 15 is movably connected to the interior of the receiving groove 4 through the pin shaft and is disposed on the surface of the suction nozzle 9 in the sleeved manner.

As a technical optimized solution of the present disclosure, by disposing the dustproof cover 15, the suction nozzle 9 can be protected, and then a contact area between the suction nozzle 9 and the external environment is reduced.

Referring to FIG. 3, the cup body 1 is formed by an inner layer 16 and an outer layer 17; the outer layer 17 is disposed on the surface of the inner layer 16 in the sleeved manner; and the tops of the inner layer 16 and the outer layer 17 are mutually welded.

As a technical optimized solution of the present disclosure, by disposing the inner layer 16 and the outer layer 17, the cup body 1 can have the thermal insulation effect, and then heat exchange between the liquid in the cup body 1 and the external environment is prevented.

The working principle and the use flow of the present disclosure are as follows: when the present disclosure is in use, the drinking hole 5, the connecting pipe 8 and the air inlets 12 are sealed by the flip cover 6 and the suction nozzle 9, so that sealing cavities are formed in the cup body 1 and the cup cover 2 respectively and are used for storing coffee; when a user requires to drink the coffee with sucking, the suction nozzle 9 may be overturned; when the sucking hole 10 in the suction nozzle 9 mutually communicates with the connecting pipe 8, the user may drink the coffee through the sucking hole 10, the connecting pipe 8 and the sleeve pipe 11; when the user requires to drink the coffee directly through a cup mouth, the suction nozzle 9 may be closed, and the flip cover 6 is rotated; and when the rubber block 13 at the bottom of the flip cover 6 is out of contact from the drinking hole 5, the user may incline the cup body 1 directly to enable the coffee to flow out of the cup body 1 through the drinking hole 5.

To sum up, for the double-drinking-mouth portable cup, by disposing the cup mouth drinking structure and a sucking drinking structure on the top of the cup cover 2, the cup cover 2 can have double drinking modes, so that the application range of the cup body 1 may be enlarged, the use convenience of the cup body 1 is greatly improved, and the problem that the existing water cup cannot meet the drinking demands in different environments due to relatively single structure and function and only one drinking mouth, so that the application range of the water cup is severely affected is solved.

What is claimed is:

1. A double-drinking-mouth portable cup, comprising a cup body (1), wherein a cup cover (2) is in threaded connection to the top of the cup body (1); a groove (3) is formed in the top of the cup cover (2); a cup mouth drinking structure is disposed in the groove (3); a receiving groove (4) mutually communicating with the groove (3) is formed in the top of the cup cover (2); and a sucking drinking structure is disposed in the receiving groove (4);

wherein the cup mouth drinking structure comprises a drinking hole (5) formed in the top of the cup cover (2); the drinking hole (5) mutually communicates with the groove (3); a flip cover (6) is movably connected to the interior of the groove (3) through a pin shaft; a snap (7) is disposed on the left side of the flip cover (6); and one side, far away from the flip cover (6), of the snap (7) extends to the left side of the cup body (1) and is mutually in clamping connection with the surface of the cup body (1).

2. The double-drinking-mouth portable cup according to claim 1, wherein the sucking drinking structure comprises a connecting pipe (8) communicating with the top of the cup cover (2); the connecting pipe (8) is disposed in the receiving groove (4); a suction nozzle (9) is movably connected to the interior of the receiving groove (4) through a pin shaft;

a sucking hole (10) is formed in the suction nozzle (9) and can mutually communicate with the connecting pipe (8); and a pipe sleeve (11) disposed in the cup body (1) is in threaded connection to the surface of the connecting pipe (8).

3. The double-drinking-mouth portable cup according to claim 2, wherein air inlets (12) are formed in the left side and the right side of the top of the cup cover (2) respectively and are formed in the bottoms of the flip cover (6) and the suction nozzle (9) respectively.

4. The double-drinking-mouth portable cup according to claim 2, wherein a sealing ring (14) is disposed on the surface of the connecting pipe (8) in a sleeved manner; and the top of the sealing ring (14) makes contact with the surface of the suction nozzle (9).

5. The double-drinking-mouth portable cup according to claim 2, wherein a dustproof cover (15) is movably connected to the interior of the receiving groove (4) through the pin shaft and is disposed on the surface of the suction nozzle (9) in the sleeved manner.

6. The double-drinking-mouth portable cup according to claim 1, wherein a rubber block (13) is fixedly connected to the bottom of the flip cover (6); and one side, far away from the flip cover (6), of the rubber block (13) is inserted into the drinking hole (5).

7. The double-drinking-mouth portable cup according to claim 1, wherein the cup body (1) is formed by an inner layer (16) and an outer layer (17); the outer layer (17) is disposed on the surface of the inner layer (16) in the sleeved manner; and the tops of the inner layer (16) and the outer layer (17) are mutually welded.

* * * * *